US008528660B2

(12) United States Patent
Santos

(10) Patent No.: US 8,528,660 B2
(45) Date of Patent: Sep. 10, 2013

(54) SYSTEM AND METHOD FOR SAFE WELL CONTROL OPERATIONS

(75) Inventor: Helio Santos, Reading (GB)

(73) Assignee: Safekick Americas LLC, Katy, TX (US)

( * ) Notice: Subject to any disclaimer, the term of this patent is extended or adjusted under 35 U.S.C. 154(b) by 335 days.

(21) Appl. No.: 13/041,216

(22) Filed: Mar. 4, 2011

(65) Prior Publication Data

US 2011/0214882 A1 Sep. 8, 2011

Related U.S. Application Data

(60) Provisional application No. 61/311,166, filed on Mar. 5, 2010.

(51) Int. Cl.
*E21B 21/08* (2006.01)

(52) U.S. Cl.
USPC ..... 175/25; 175/38

(58) Field of Classification Search
USPC ..... 175/24, 25, 38, 48
See application file for complete search history.

(56) References Cited

U.S. PATENT DOCUMENTS 3,550,696 A 12/1970 Kennedy
3,552,502 A 1/1971 Wilson
3,971,926 A * 7/1976 Gau et al. ..... 708/3
5,080,182 A 1/1992 Thompson
6,484,816 B1 * 11/2002 Koederitz ..... 175/25
6,668,943 B1 * 12/2003 Maus et al. ..... 175/5
7,497,266 B2 * 3/2009 Fossli ..... 166/358
2002/0112888 A1 8/2002 Leuchtenberg

OTHER PUBLICATIONS

International Search Report and written opinion of corresponding application No. PCT/US2011/027259 dated May 12, 2011.

* cited by examiner

*Primary Examiner* — William P Neuder
(74) *Attorney, Agent, or Firm* — Gary L. Bush; Andrews Kurth LLP

(57) ABSTRACT

A system and method for safely controlling a well being drilled or that has been drilled into a subterranean formation in which a conventional blow-out preventer operates to close the well bore to atmosphere upon the detection of a fluid influx event. Fluid pressures as well as fluid flow rates into and out of the well bore are measured and monitored to more accurately and confidently determine the fracture pressure and pore pressure of the formation and perform well control operations in response to a fluid influx event. During a suspected fluid influx event, one or more of the fluid flow and pressure measurements are used to confirm the fluid influx event and to safely regain well control by circulating the fluid influx out of the well through a choke line while maintaining the pressure inside the well between specified, selected limits, such as between the fracture and pore pressures.

35 Claims, 6 Drawing Sheets

SYSTEM AND METHOD FOR SAFE WELL CONTROL OPERATIONS

CROSS REFERENCE TO RELATED APPLICATION

This application is based on U.S. provisional patent application No. 61/311,166, filed on Mar. 5, 2010, the priority of which is claimed.

BACKGROUND OF THE INVENTION

1. Field of the Invention

This invention relates generally to a system and method for the drilling, completion and work-over of oil and/or gas wells. Specifically, the invention relates to the control of oil and/or gas wells during the period when the blow-out preventer (BOP) is closed, or is in the process of being closed, due to events, such as kicks, that occur during drilling, completion, or while working over the well.

2. Description of the Related Art

During the drilling of subterranean wells, a fluid ("mud") is typically circulated through a fluid circulation system comprising a drilling rig and fluid treating equipment located substantially at or near the surface of the well (i.e., earth surface for an on-shore well and water surface for an off-shore well). The fluid is pumped by a fluid pump through the interior passage of a drill string, through a drill bit and back to the surface through the annulus between the well bore and the drill pipe.

A primary function of the fluid is to maintain a primary barrier inside the well bore to prevent formation fluids from entering the well bore and flowing to surface. A blow-out preventer (BOP), which has a series of valves that may be selectively closed, provides a secondary barrier to prevent formation fluids from flowing uncontrolled to surface. To achieve a primary barrier inside the well bore using the fluid, the hydrostatic pressure of the fluid is maintained at a level higher than the formation fluid pressure ("pore pressure"). Weighting agents may be added to the fluid to increase the fluid density, thereby ensuring that the hydrostatic pressure is always above the pore pressure. If, during drilling of the well bore, a zone is encountered having a higher pore pressure than the fluid pressure inside the well bore, an influx of formation fluid will be introduced into the well bore. Such occurrence is an undesirable event and is known as taking a "kick." This same situation can occur not only during drilling, but also during completion, work-over or intervention.

When a kick is taken, the invading formation liquid and/or gas may "cut," or decrease, the density of the fluid in the well bore annulus, such that an increasing amount of formation fluid enters the well bore. Under such circumstances, control of the well bore may be lost due to breach of the primary barrier. Such an occurrence may be noted at the drilling rig in the form of: (1) a change in pressure in the well bore annulus, (2) a change in fluid density, and/or (3) again in fluid volume in the fluid system tanks ("pit volume"). When a kick is detected, or suspected to have entered the well bore, fluid circulation is conventionally halted and the well bore closed in/shut in by closing the BOP. The pressure buildup in the well bore annulus, pit gain and shut in drill pipe and casing pressures are then monitored and measured. Appropriate well-killing calculations may also be performed while the well is closed in. Before resuming operations, a known well-killing procedure may be followed to circulate the kick out of the well bore, circulate an appropriately weighed fluid ("kill fluid") into the well bore, and ensure that well control has been safely regained. Typically, the intent of the operator while circulating a kick out of a well and circulating the kill fluid is to ensure that another kick does not enter the well. If, however, while performing these tasks another kick enters the well, the entire well bore condition again changes. The operator may subsequently lose control of the well, because the monitored and measured parameters are transient and confusing as a result of the previous kick. Furthermore, it will be more difficult to ensure that the well control procedures were successfully completed and that the operator has effectively regained control of the well bore to permit recommencement of operations.

One of the requirements for safely and effectively killing the well, and circulating an appropriate kill fluid, is to hold the pressure inside the well bore as constant as possible, above the formation pore pressure and below the formation fracture pressure. The first task is, therefore, to ensure accurate knowledge of the pore and fracture pressures as a function of depth, and to properly calculate the correct fluid weight to be circulated. If the pressure inside the well bore oscillates too much during the circulation of the kick out of the well bore, then there is high risk that the pressure inside the well bore will fall below the formation pressure and a secondary kick will be taken while the process of controlling the first one is ongoing. Alternatively, if the pressure inside the well bore oscillates and reaches the fracture pressure, fluid losses into the formation are induced. This causes the integrity of the well bore to be severely jeopardized and makes the necessary well control operations much more difficult. As previously stated, such scenarios should be avoided.

The two most common methods for circulating the kill fluid and circulating the kick out of the well bore are: the Driller's method and the Wait and Weight method. The Driller's method may be utilized when kill weight fluid is not yet available for circulation. In the Driller's method, the original fluid weight may be used to circulate the influx of formation fluids from the well bore. Thereafter, kill weight mud ("KWM") may be circulated into the drill pipe and the well bore. Although two circulations may be required to effectuate the Driller's method, this method may be quicker than the subsequently described variation. In the Wait and Weight or "Engineer's" method, KWM is prepared and then circulated down the drill string and into the well bore to remove the influx of formation fluids from the well bore and to kill the well, in one circulation. This method may be preferable in order to maintain the lowest casing pressure while circulating the kick from the well bore, thereby minimizing the risk of damaging the casing, fracturing the formation and/or creating an underground blow-out. In either the Driller's method or the Wait and Weight method, a substantially constant pressure inside the well bore, above the pore pressure and below the fracture pressure, should be maintained.

The Driller's method and the Wait and Weight method are only suitable, however, for use in commonly encountered well control situations. There are several other more complex situations faced while regaining control of the well bore which require a more sophisticated approach. In situations where the drill bit is off bottom, there is no drill string inside the well bore, or the drill string is parted, more complex methods are needed, such as volumetric, dynamic volumetric, or lube and bleed methods, to ensure that control of the well is restored. In some cases, there is no margin to allow circulation of the influx without fracturing the formation. In such cases, the alternative is to bullhead the influx back into the formation and not to circulate the influx out of the well bore. These complex methods are more difficult to implement because several variables must be controlled, and this complexity is often more than the rig crew can handle. Thus, well control experts are frequently moved to the rig site to assist with well control, if these more complex well control methods are employed.

In the conventional drilling of a well, the blow-out preventer (BOP) remains open and the return of the fluids from the well is directed through a fluid return line to a shale shaker and fluid system tanks on the surface. Thus, the well is drilled while being open to the atmosphere and without the possibility of applying pressure at surface. If an indication of an influx is detected at anytime, the BOP is closed and a well control procedure is initiated. When a fluid influx occurs it is a sign that the pressure inside the well bore is lower than the formation pressure, and that the fluid weight should be increased to restore a balanced condition. As previously described, there are many different ways of controlling the well after the detection of a fluid influx. The preferred way in which a well is controlled is dependent on a number of factors including, but not limited to, the configuration of the well, the operational condition of the well at the time the detected influx, whether the drill bit is on bottom or off bottom, whether the drill string is parted, and/or whether the drill string is completely out of the well. The Driller's method and the Wait and Weight method, described above, are two of the most popular ways to control a well after influx detection when the drill bit is on bottom, however, other methods and variations thereof are implemented depending on the particular drilling company. When the BOP is closed, the return of the fluid is diverted to the rig well control choke manifold through a choke line, wherein one or more adjustable chokes control the pressure (i.e., backpressure) in the choke line and in the annulus.

Conventional well control procedure involves several steps, which are well known to those skilled in the art:

First, the well is shut in by closing the BOP in order to measure the pressures in the annulus and inside the drill string, and thereby provide an indication of the amount of additional pressure required to rebalance the well;

Next, the fluid influx is circulated out of the well while controlling the well pressure at the surface appropriately to prevent a second influx from entering the well bore (as previously stated, in some cases there is no margin to allow circulation of the influx without fracturing the formation, which leads to the decision to bullhead the influx back into the formation instead of circulating it out of the well bore);

Next, a heavier fluid is circulated through the well to restore the hydrostatically overbalanced condition, which is a required condition for many oil and/or gas well drilling operations;

Finally, confirmation is made that the well is hydrostatically overbalanced by checking the pressures in the annulus and inside the drill string so that the BOP can be reopened to resume operations.

During execution of the conventional well control procedure, the steps are conducted while relying on pressure readings as measured in the injection line, called standpipe pressure and as measured in the choke line, called casing pressure, and in a few cases, on the volume of fluid in the pits. Relying solely on pressure readings, however, does not allow the driller to completely understand downhole events, such as ascertaining the hydrostatically underbalanced condition based on the time the influx was taken, verifying that an influx indeed entered the well bore or ensuring that the well is under control. Furthermore, using the pit volume as indicator of well condition during a well control method is far from accurate.

In addition to well control, the BOP may be closed for other reasons, such as to conduct a leak-off test in order to determine the fracture pressure of the formation. Current systems and methods for determining formation fracture pressure and formation pore pressure, however, are inaccurate. For example, the pore pressure derived from stabilized surface standpipe and casing pressure readings measured after the BOP has been closed is often far from accurate, and in many cases, there is no influx into the well bore. The sole reliance on pressure readings and their misinterpretation leads to this result. Moreover, the use of inaccurately measured fracture and pore pressures can have serious consequences for the economics of the well. For instance, the pore pressure is used to define the new mud/fluid weight required to be circulated through the well after a kick is detected in order to return the well to a hydrostatically overbalanced condition. Thus, if the determined pore pressure is inaccurate due to a lighter fluid presence in the well bore, and not the result of a hydrostatically or dynamically underbalanced situation, the typical procedure is to needlessly introduce heavier weight fluid into the well bore.

As stated, the misinterpretation of non-kick events, based solely on pressure readings or pit volume measurements, can lead to false alarms of kicks. An action that may be taken in response to these false alarms is the circulation of fluid with an unnecessary increase in fluid weight, which can cause subsequent operational problems, such as a loss of circulation, a stuck pipe and/or a low rate of well bore penetration. For instance, the fluid weight used to kill the well is selected to be much higher than needed, thereby causing severe problems when operations are resumed. In certain situations, this results in the well being prematurely abandoned. Even if the well is not abandoned, the huge amount of resources wasted by the lack of accuracy and controllability of current well control methods is costly.

Furthermore, the misinterpretation of downhole events can, in many cases, lead to the taking of secondary influxes while attempting to control the first kick. This can and often does lead to well blow-outs. For example, there were 28 out-of-control blow-outs alone in the United States in 2008. Brian Kraus, Drilling Contractor, July/August 2009, at 100-01. Most of these blow-outs caused property damage, some caused environmental damage, and at least one blow-out caused a busy highway to be diverted because the fire at the drilling site was too close. Another reason that many kicks can get out of control and turn into devastating blow-outs is the lack of experience and knowledge of the personnel at the rig site concerning such events. In many instances, the on-site personnel are unable to interpret the fluid influx situation, perform the necessary calculations, and/or properly implement the required well control procedures.

Improving the safety and controllability of well control operations after the BOP has been closed is a major concern on the majority of worldwide drilling rigs. In an attempt to improve well control procedures and the overall safety of conventional operations, several systems and methods have recently been developed which focus on improved kick detection, while others concentrate on controlling pressures more accurately during circulation of the kick and displacement of the kill mud. Most of these systems and methods, however, rely solely on pressure monitoring and measurement to regain control of the well after the BOP has been closed. While pressure measurements can, in some limited cases, provide a good indication of the events inside the well bore with the BOP closed, pressure measurements alone do not provide a full and complete understanding of what events are occurring downhole. Likewise, pressure measurements alone do not ensure that false indications of kicks are prevented or permit the accurate assessment of fracture and pore pressures. Considering the problems associated with current strategies of well control when the BOP is closed, an improved well control system and method provides several advantages. This application is based on U.S. provisional patent application No. 61/311,166, filed on Mar. 5, 2010, which is incorporated herein by reference.

3. Identification of Objects of the Invention

An object of the invention is to accomplish one or more of the following:

Provide a system and method to permit the safe cessation of drilling operations in response to an indicated or suspected onset of a kick event;

Provide a system and method for controlling oil and/or gas wells after closing the blow-out preventer;

Provide a system and method for more accurately determining the fracture and pore pressures of the formation;

Provide a system and method for confirming if the fluid weight is insufficient to hydrostatically balance exposed formations, and if confirmed, determining an accurate value for the fluid weight increase required to restore hydrostatic balance or overbalance;

Provide a system and method for controlling the pressure at any specific, selected depth inside the well bore between specified limits, such as between the formation fracture pressure and the formation pore pressure;

Provide a system and method for maintaining control of oil and/or gas wells such that drilling and other operations on these wells may be conducted in sensitive formations;

Provide a system and method which reduces the risk of well blow-outs, which could result in life and/or properties losses;

Provide a system and method for enhancing hands-on training and competence assessment using the well control equipment of the rig;

Provide a system and method for controlling an oil and/or gas well such that experts not located at the rig site may be involved earlier in well control procedures; and Provide a system and method for the collection, interpretation and display of well control-related data for timely and effective participation in well control procedures by experts located remotely from the rig.

Other objects, features, and advantages of the invention will be apparent from the following specification and drawings to one skilled in the art.

SUMMARY OF THE INVENTION

One or more of the objects identified above, along with other features and advantages of the invention are incorporated in a system and method for monitoring and controlling an oil and/or gas well just prior to and/or after closure of a conventional blow-out preventer (BOP) associated with the well. In normal operations in which the BOP is closed, or in operations in which the BOP is closed in response to any suspicion, sign or indication of a fluid influx, a preferred implementation of the system and method of the invention (1) measures and monitors both the pressures and flow rates in and out of the well bore from the time the BOP is closed and operation is interrupted until the BOP is reopened to resume the operations, (2) measures and monitors both the pressure and flow rates in and out of the well so as to provide a more accurate determination of the pore and fracture pressures, which is used to safely regain well control before resuming operations, and/or (3) uses the measured pressure and flow rate data to perform well control operations with greater accuracy, controllability and confidence.

In a preferred implementation of the invention, a fluid flow rate measurement device, such as a fluid volume or mass flow rate meter, is disposed within the choke line between the rig choke manifold and the mud gas separator to measure and monitor the flow rate of fluid out of the well bore through the choke line during the period when the conventional BOP is closed for any specific operation or in response to any sign or indication of a fluid influx event. A fluid flow measurement device is also disposed within the fluid injection line, to measure and monitor flow rate of fluid into the well bore at all times. The standpipe and casing pressures are also measured and monitored by measuring and monitoring the pressures within the fluid injection line and the choke line, respectively, using pressure measurement devices. All relevant data are preferably acquired and transmitted to a central control unit before, during, and after the conventional BOP has been closed for any specific operation or in response to a suspected fluid influx event. This data is preferably stored at the rig site but is available in real time to experts located away from the well. Thus, relevant well control data can be made available to well control experts during well control events prior to their arrival on site.

The measured fluid flow rates and fluid pressures permit the suspected fluid influx event to be confirmed and the pore and fracture pressures of the formation to be determined with greater accuracy, as further described herein. Based on the accurately determined pore and fracture pressures, the central control unit controls a flow control device disposed in the choke line to apply backpressure on the well so as to maintain the pressure inside the well bore between specified or conditional limits including, but not limited to, the pore pressure and the fracture pressure during the entire well control procedure. Confirming the suspected fluid influx and determining an accurate pore pressure also permit the correct fluid weight to be determined so as to restore the overbalanced condition for continued operation. Furthermore, based on the measured flow rates and/or pressures, one or more of the standpipe pressure, casing pressure, and the pressure at a given point inside the well bore may be controlled manually or automatically to facilitate well control operations. Such well control operations may include circulating the fluid influx out of the well bore and/or injecting a heavier fluid into the well bore, thereby displacing lighter fluid from the well bore, or bullheading the fluid influx back into the formation. The system also facilitates hands-on training for the rig crew as well as competence assessments of the rig crew to be performed using the actual rig well control equipment.

BRIEF DESCRIPTION OF THE DRAWINGS

By way of illustration and not limitation, the invention is described in detail hereinafter on the basis of the accompanying figures, in which.

DESCRIPTION OF THE PREFERRED IMPLEMENTATIONS OF THE INVENTION

Figure 1:
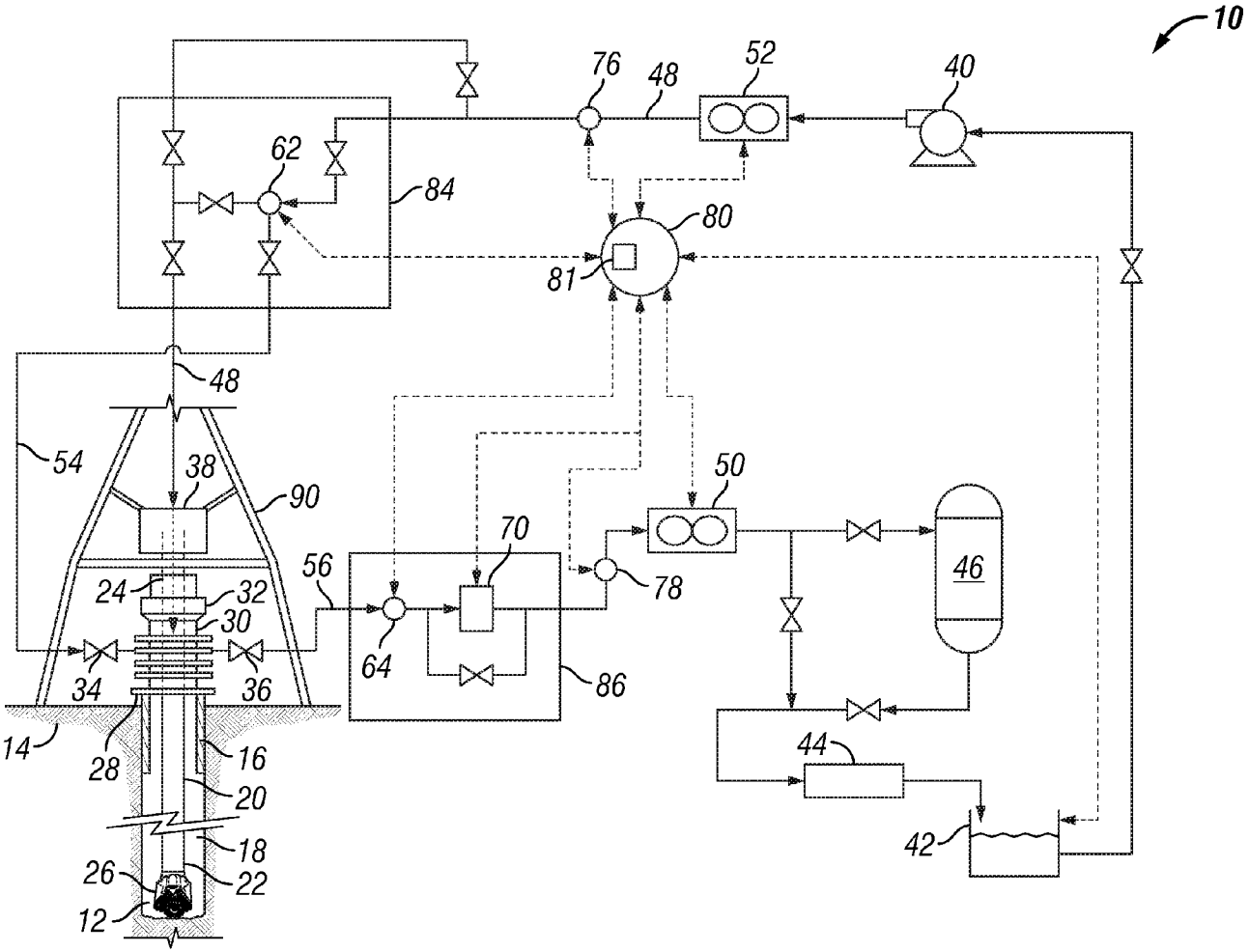
FIG. 1 is a schematic view of a preferred implementation of the system in which fluid flow rate measurement devices are disposed in a fluid injection line and in a choke line downstream of a flow control device to measure fluid flow rate into and out of the well bore while a conventional blow-out preventer is closed.

A preferred implementation of the invention alleviates one or more of the deficiencies of the prior art and incorporates at least one of the objects previously identified. As shown in FIG. 1, a preferred implementation of the drilling system 10 includes a tubular drill string 20 suspended from a drilling rig 90. The drill string 20 has a lower end 22 which extends downwardly through a BOP stack 30 and into borehole/well bore 12. A drill bit 26 is attached to the lower end 22 of drill string 20. A drill string driver or turning device 38, comprising either a rotary drive system (not shown) or a top drive system 38, is operatively coupled to an upper end 24 of the drill string 20 for turning or rotating the drill string 20 along with drill bit 26 in the borehole 12. A conventional surface fluid/mud pump 40 pumps fluid from a surface fluid reservoir 42 through a fluid injection line 48, through the upper end 24 of drill string 20, down the interior of drill string 20, through drill bit 26 and into a borehole annulus 18. The borehole annulus 18 is created through the action of turning drill string 20 and attached drill bit 26 in borehole 12 and is defined as the annular space between the interior/inner wall or diameter of the borehole 12 and the exterior/outer surface or diameter of the drill string 20.

A conventional BOP stack 30 is coupled to well casing 16 via a wellhead connector 28. Typically, the BOP stack 30 includes one or more pipe rams, one or more shear rams, and one or more annular BOPs 32. When drilling is stopped (i.e., the drill string driver 38 is no longer turning the drill string 20 and drill bit 26), the one or more conventional annular BOPs 32 can be closed to effectively close the borehole annulus 18/wellbore 12 from the atmosphere. A kill line 54 couples between the fluid injection line 48 via a standpipe manifold 84 and the conventional BOP stack 30 via kill line valve 34. The kill line 54 permits fluid communication between the conventional surface fluid/mud pump 40 and the well bore annulus 18 when kill line valve 34 and valving in the standpipe manifold 84 are opened. Thus, while the BOP 32 is closed, conventional surface fluid/mud pump 40 may be used to pump fluid from reservoir 42 into the borehole annulus 18 via fluid injection line 48, standpipe manifold 84, kill line 54, kill line valve 34, and BOP stack 30. Alternatively, while the BOP 32 is closed, the conventional surface fluid/mud pump 40 may be used to pump fluid from reservoir 42 into the borehole annulus 18 via the fluid injection line 48, standpipe manifold 84, drill string 20 and drill bit 26.

A choke line 56 couples between the conventional BOP stack 30 via choke line valve 36 and the surface fluid reservoir 42 via rig well control choke manifold 86. The rig well control choke manifold 86 includes a flow control device 70, such as a choke, disposed in the choke line 56. The flow control device 70 controls flow rate through the choke line 56 thereby controlling pressure upstream of the flow control device 70 and thus, backpressure to the well bore annulus 18 while the BOP 32 is closed. A mud-gas separator 46 and a shale shaker 44 are also preferably fluidly coupled to the choke line 56 and are positioned between the flow control device 70 and surface fluid reservoir 42. Thus, when choke line valve 36 and flow control device 70 are opened after the BOP 32 is closed, fluid from the borehole annulus 18 is permitted to flow up through BOP stack 30, through choke line valve 36, through choke line 56, through rig well control choke manifold 86, through mud-gas separator 46, through shale shaker 44 and into surface fluid reservoir 42.

Upon detection of a fluid influx, drilling is ceased (i.e., drill string driver 38 stops rotating the drill string 20 and drill bit 26) and the one or more conventional BOPs 32 are closed (i.e., the borehole 12 and borehole annulus 18 are closed to atmosphere). Depending on the specific well control procedure adopted by the drilling company and the well bore geometry/configuration, fluid may be pumped into the well bore 12 solely through the drill string 20, solely through the kill line 54, or through both the drill string 20 and the kill line 54. On some rigs with appropriate lines and valving (not shown), fluid may be injected into the annulus 18 using the choke line 56.

If fluid is to be pumped solely through kill line 54, then the kill line valve 34 is opened and valving in the standpipe manifold 84 is configured to fluidly couple the fluid injection line 48 and the kill line 54, thereby permitting pump 40 to pump fluid directly into the well bore annulus 18. The valving in the standpipe manifold 84 is further configured to stop flow between the fluid injection line 48 and the drill string 20. In this configuration, the fluid injection line 48, the standpipe manifold 84, the kill line 54, the BOP stack 30, the well bore annulus 18, and the choke line 56 define a fluid pathway through the borehole 12. If fluid is to be pumped solely through the drill string 20, then the kill line valve 34 is closed and the valving in the standpipe manifold 84 is configured to permit flow between the fluid injection line 48 and the upper end 24 of the drill string 20 and to stop flow into the kill line 54. In this configuration, the standpipe manifold 84, the fluid injection line 48, the drill string 20, the well bore annulus 18, and the choke line 56 define a fluid pathway through the borehole 12.

If both the kill line 54 and the drill string 20 are to be used to pump fluid into the well bore annulus 18, then the kill line valve 34 is opened and the valving in the standpipe manifold 84 is configured to permit fluid flow from the fluid injection line 48 into both the kill line 54 and the upper end 24 of the drill string 20.

Typically, after an influx is detected, the BOP 32 is closed and the standpipe and casing pressures are measured to confirm and assess the severity of the influx and to determine the increase in fluid weight needed for circulation through the well bore 12. A greater weight fluid is pumped through the drill string 20 and/or kill line 54 in order to increase the fluid weight within the borehole annulus 18. The increased weight of the fluid increases the static pressure exerted by the fluid within the well bore 12, which prevents additional influx from entering into the well bore annulus 18 from the formation 14.

In order to circulate heavier fluid through the well bore 12 and any fluid influx out of the well bore 12 while the conventional BOP 32 is closed, choke line valve 36 is opened to permit such fluid to flow under pressure up from the borehole annulus 18 through the choke line valve 36, into choke line 56, through flow control device 70 and back to the surface fluid reservoir 42. The flow control device 70 controls the fluid flow rate therethrough, and thus backpressure on the well bore 12 and well bore annulus 18, by preferably controlling or adjusting the size of an orifice (not shown) through which fluid is permitted to flow through choke line 56. A larger-sized orifice equates to a greater through flow and a decreased backpressure while a smaller-sized orifice equates to a lesser through flow and a greater backpressure. The use of flow control devices to restrict flow through a pipe or flow line is well known to those skilled in the art. Such flow control devices include, but are not limited to, chokes, size-adjustable orifices, and various valves.

A central control unit 80 is preferably arranged and designed to receive measurement signals from a number of measurement devices, to use the received signals to generate control signals to control the flow control device 70 and flow therethrough, and to transmit these control signals to the flow control device 70, thereby controlling the flow through choke line 56. Central control unit 80 may be any type of computing device preferably having a user interface and software 81 installed therein, such as a computer, that is capable of but not limited to, performing one or more of the following tasks: receiving signals from a variety of measurement devices, converting the received signals to a form exploitable for computing and/or monitoring, using the converted signals for computing and/or monitoring desired parameters, generating signals representative of computed parameters, and transmitting generated signals. With respect to the flow control device 70, the central control unit 80 is preferably arranged and designed to transmit generated control signals wirelessly or via a wired link (shown by the dotted lines on FIGS. 1-4) to the flow control device 70. The control signals received by the flow control device 70 from the central control unit 80 cause the orifice of the flow control device 70 to either fully open, fully close, or to open or close to some position therein between. While the flow control device 70 may be controlled automatically by the central control unit 80 as described above, the flow control device 70 may also be manually controlled by an operator to adjust the fluid flow ate or pressure through the flow control device 70 at the discretion of the operator.

Figure 2:
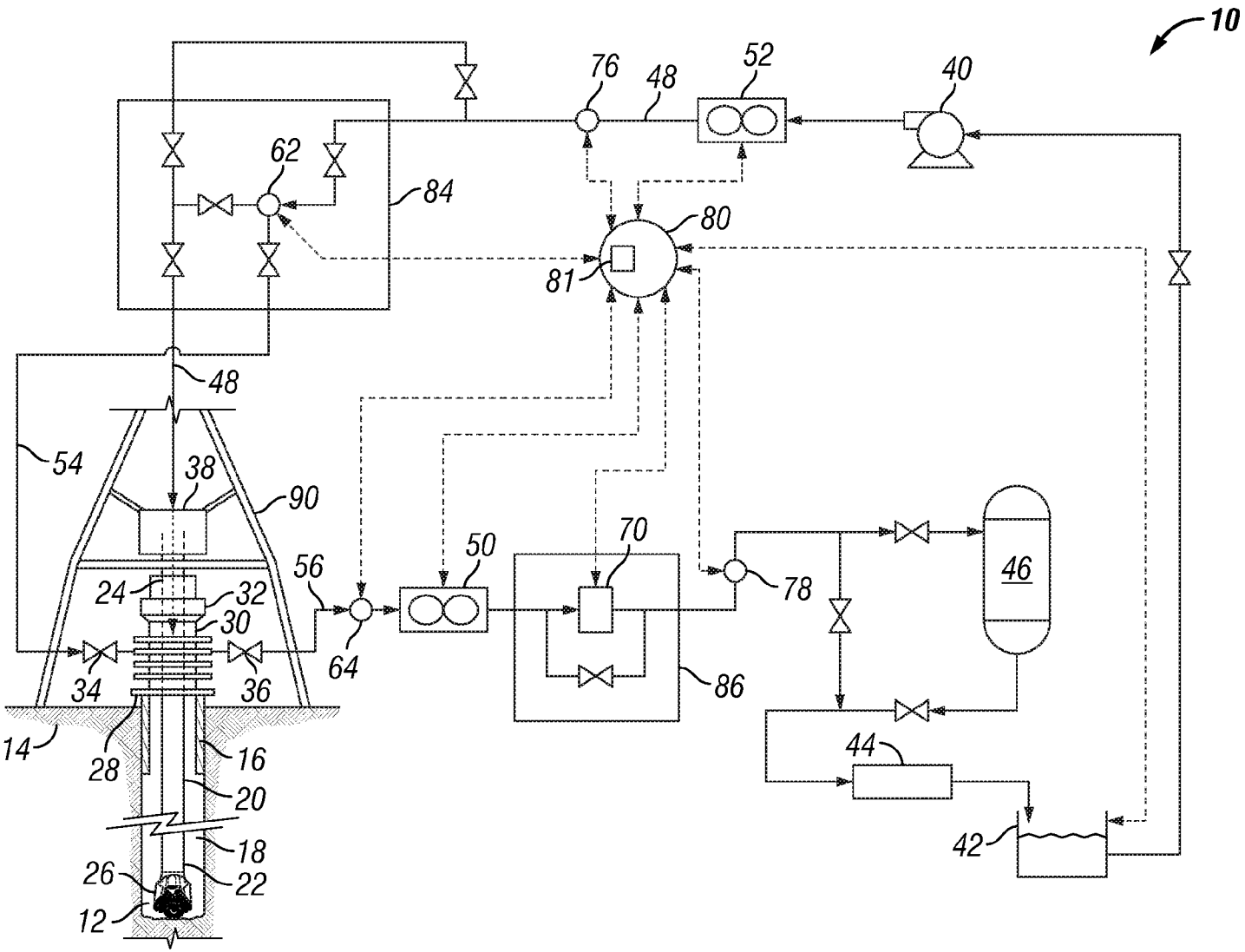
FIG. 2 is a schematic view of an alternative preferred implementation of the system shown in FIG. 1 in which the fluid flow rate measurement device disposed in the choke line is positioned upstream of the flow control device to measure fluid flow rate out of the well bore while the conventional blow-out preventer is closed.

As shown in FIG. 1, an outlet fluid flow rate measurement device 50, such as a volume or mass flow rate meter, is preferably used to measure the fluid flow rate out of the well bore 12 while the conventional blow-out preventer 32 is closed. Such fluid flow rate measurement device 50 is preferably a coriolis flow rate meter, an ultrasonic flow rate meter, a magnetic flow rate meter or a laser-based optical flow rate meter, but may be any suitable type known to those skilled in the art. The outlet fluid flow rate measurement device 50 is arranged and designed to generate a signal $F_{out}(t)$, which is representative of actual flow rate out of the well bore 12 through the choke line 56 as a function of time (t). The outlet fluid flow rate measurement device 50 transmits the signal $F_{out}(t)$, preferably in real time, to the central control unit 80, which receives and processes the signal. The outlet fluid flow rate measurement device 50 is preferably disposed in the choke line 56 between the flow control device 70 and the rig mud gas separator 46. However, as shown in FIG. 2, the outlet fluid flow rate measurement device 50 may alternatively be disposed in the choke line 56 upstream of the flow control device 70 (i.e., between the well bore annulus 18 and the flow control device 70).

Figure 3:
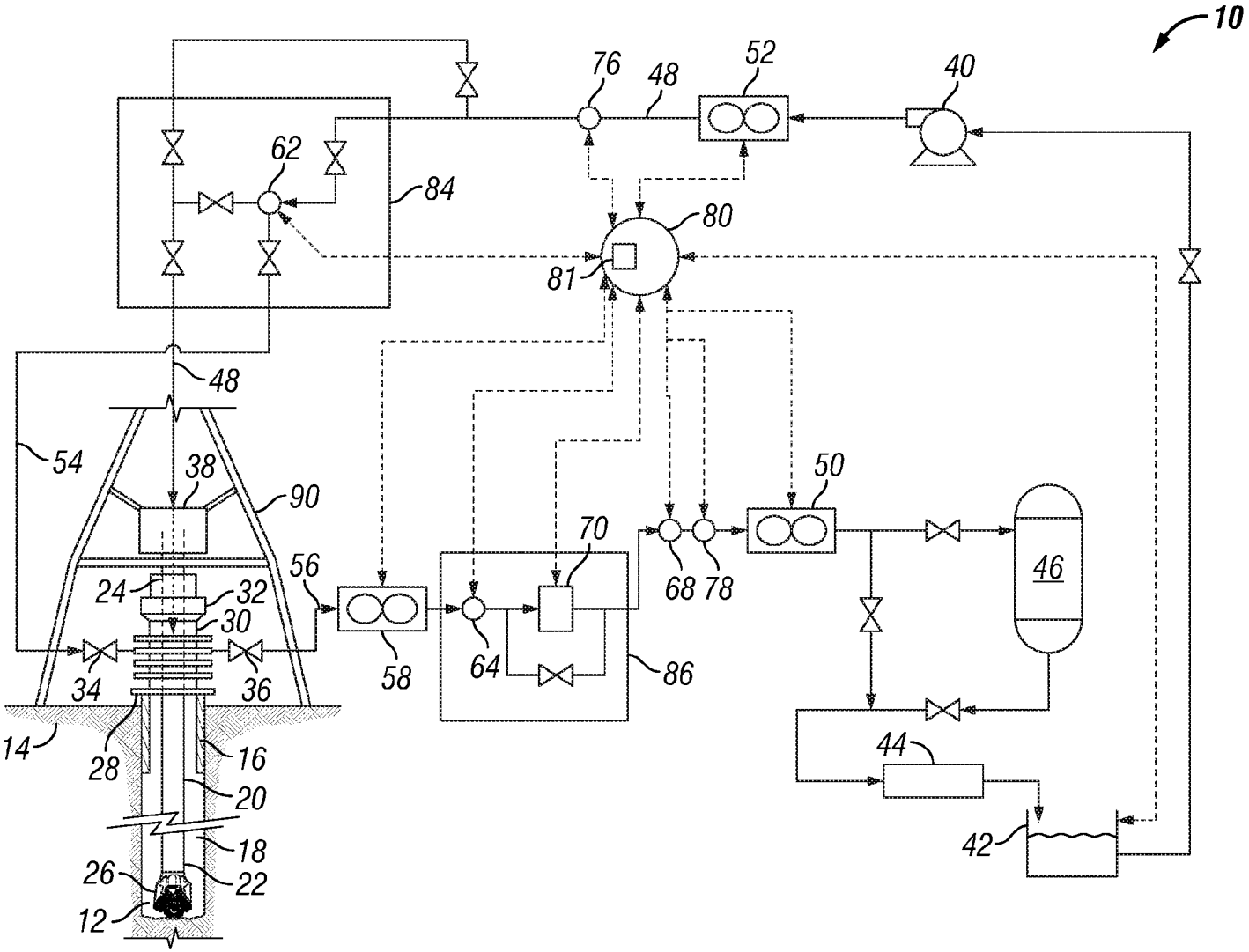
FIG. 3 is a schematic view of an alternative preferred implementation of the system shown in FIG. 1 in which flow rate measurement devices are disposed in the choke line both upstream and downstream of the flow control device to measure flow rate out of the well bore and pressure measurement devices are disposed in the choke line both upstream and downstream of the flow control device to measure pressure in the choke line.

In an alternative preferred implementation, shown in FIG. 3, the outlet fluid flow rate measurement device 50 is disposed in the choke line 56 downstream of the flow control device 70 (i.e., between the flow control device 70 and the mud gas separator 46) and a second outlet fluid flow rate measurement device 58 is disposed in the choke line 56 upstream of the flow control device 70. The outlet fluid flow rate measurement devices 50, 58 are similarly arranged to generate a signal $F_{out}(t)$ and a signal $F_{out2}(t)$, respectively, which are representative of actual flow rates out of the well bore 12 through the choke line 56 at the respective measurement device 50, 58 as a function of time (t). The outlet fluid flow rate measurement devices 50, 58 transmit their respective signal $F_{out}(t)$ and $F_{out2}(t)$, preferably in real time, to the central control unit 80, which receives and processes the signal. The fluid upstream of the flow control device 70 may experience a higher pressure than the fluid downstream of the flow control device 70. Therefore, the use of first 50 and second 58 outlet fluid flow rate measurement devices provides an analysis of fluid compressibility and a better understanding of fluid volume expansion as a function of pressure, both of which permit a more accurate measurement of fluid flow rate out of the bore hole 12. The effects of turbulence can also be determined and thus controlled with the use of two outlet flow rate measurement devices 50, 58 arranged in series.

Returning to FIG. 1, an inlet fluid flow rate measurement device 52, such as a volume or mass flow rate meter is preferably used to measure the fluid flow rate into the well bore 12 while the conventional blow-out preventer 32 is closed. The inlet fluid flow rate measurement device 52 is preferably a coriolis flow rate meter, an ultrasonic flow rate meter, a magnetic flow rate meter or a laser-based optical flow rate meter, but may be any suitable type known to those skilled in the art. Alternatively, even a simple device to measure the strokes of the conventional surface fluid/mud pump 40 as a function of time can serve as an inlet fluid flow rate measurement device. The inlet fluid flow rate measurement device 52 is arranged and designed to generate a signal $F_{in}(t)$, which is representative of actual fluid flow rate through the fluid injection line 48 (i.e., an inlet line coupled between pump 40 and drill string 20) as a function of time (t). The inlet fluid flow rate measurement device 52 transmits the signal $F_{in}(t)$ in real time to the central control unit 80, which receives and processes the signal. The inlet fluid flow rate measurement device 52 is preferably disposed in the fluid injection line 48 between the conventional surface fluid/mud pump 40 and the standpipe manifold 84, such that the inlet fluid flow rate measurement device 52 measures fluid flow rate into the borehole 12 regardless of whether fluid flow is through the drill string 20 or through the kill line 54.

Figure 4:
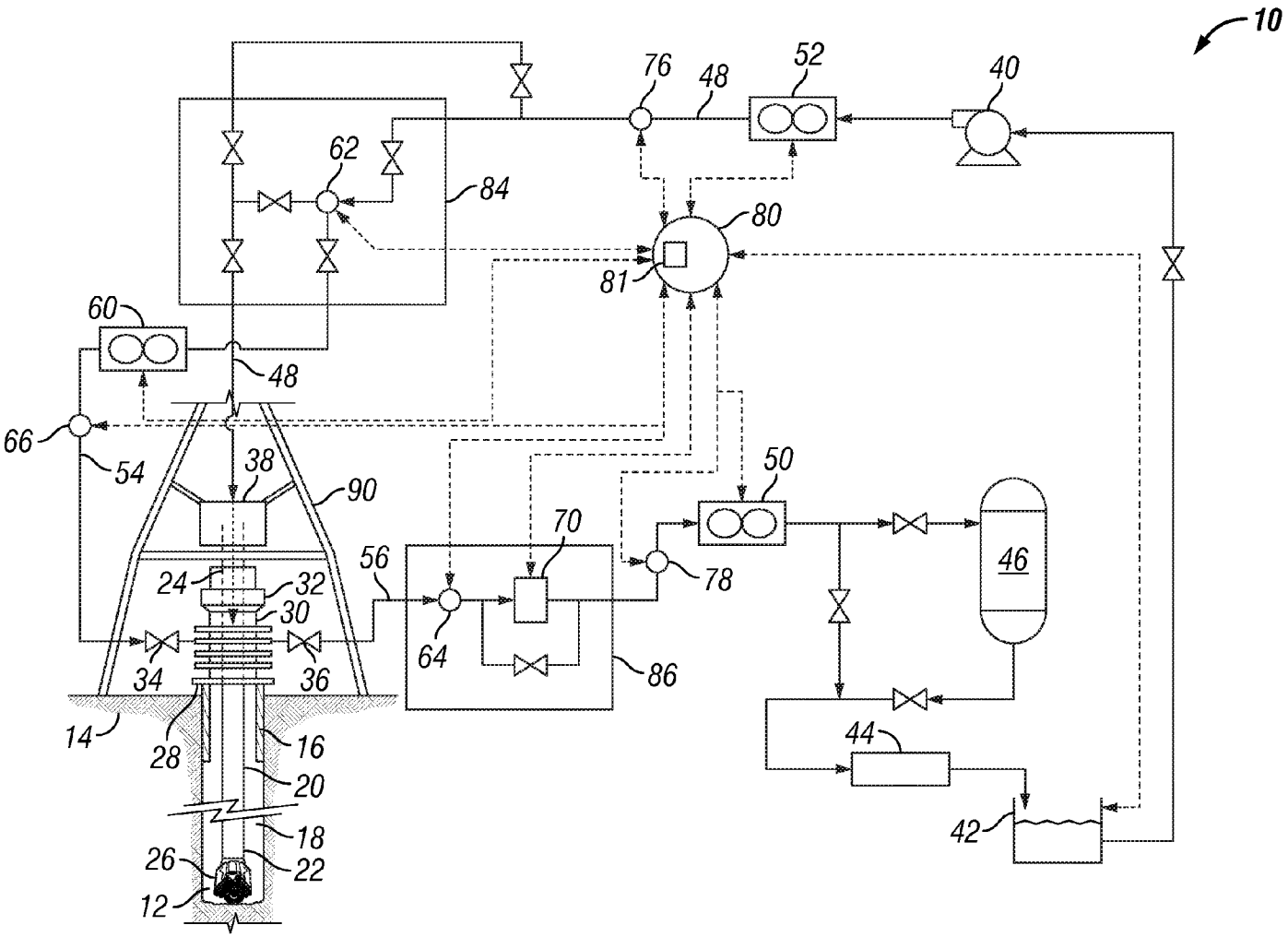
FIG. 4 is a schematic view of an alternative preferred implementation of the system shown in FIG. 1 in which fluid flow rate and pressure measurement devices are disposed in each of the kill line and the fluid injection line (and in the choke line) to measure fluid flow rate and pressure into (and out of) the well bore while the conventional blow-out preventer is closed.

Alternatively, as shown in FIG. 4, the inlet fluid flow rate measurement device 52 is disposed in the fluid injection line 48 between the conventional surface fluid/mud pump 40 and the standpipe manifold 84 and a second inlet fluid flow rate measurement device 60 is disposed in the kill line 54. The inlet fluid flow rate measurement device 52 is arranged and designed to generate a signal $F_{in}(t)$, which is representative of actual flow rate into the well bore 12 through the injection line 48 as a function of time (t). The second inlet fluid flow rate measurement device 60 is arranged and designed to generate a signal $F_{in2}(t)$, which is representative of actual flow rate into the well bore 12 through the kill line 54 (i.e., an inlet line coupled between standpipe manifold 84 and well bore annulus 18) as a function of time (t). The inlet fluid flow rate measurement devices 52, 60 transmit their respective signal $F_{in}(t)$ and $F_{in2}(t)$, preferably in real time, to the central control unit 80, which receives and processes the signal. Based on the signals received, the central control unit 80 calculates the total flow rate of fluid into the well bore 12 regardless of whether the fluid flow is through the drill string 20 alone, the kill line 54 alone, or a combination of both.

As previously stated, the inlet 52, 60 and outlet 50, 58 flow rate measurement devices preferably send flow rate signals in real time to the central control unit 80, thereby permitting the fluid flow rate into and out of the well bore 12 to be continuously monitored via the central control unit 80 while the conventional BOP 32 is closed. Fluid flow from the borehole 12 through the choke line 56 is controlled manually, or automatically by the central control unit 80, via flow control device 70. Fluid flow into the well bore annulus 18 via the fluid injection line 48 and/or the kill line 54 may also be controlled by the central control unit 80 via manipulation of the valving in the standpipe manifold 84 to select a particular fluid flow pathway, to reduce flow through a particular fluid flow pathway, or to stop flow through a particular line. Alternatively, the central control unit 80 may automatically control, or an operator may manually control, the fluid flow into the well bore annulus 18 by increasing, decreasing, or stopping the operation of conventional surface fluid/mud pump 40.

As shown in FIG. 1, an inlet pressure measurement device 62, such as a pressure sensor, is disposed in the fluid injection line 48 in the proximity of the standpipe manifold 84. However, the inlet pressure sensor 62 could alternatively be disposed elsewhere in the fluid injection line 48, but preferably in close proximity to the inlet flow rate measurement device 52. The inlet pressure measurement device 62 is arranged and designed to generate signal $P_{in}(t)$, which is representative of the pressure in the fluid injection line 48 (i.e., the standpipe pressure) as a function of time (t). The inlet pressure measurement device 62 transmits signal $P_{in}(t)$, preferably in real time, to the central control unit 80, which receives and processes the signal. As shown in FIG. 4, the inlet pressure measurement device 62 is disposed in the fluid injection line 48 as described above, however, a second inlet pressure measurement device 66 is associated with the second inlet flow rate measurement device 60 positioned in the kill line 54. Thus, an inlet pressure measurement device is preferably associated with each of a plurality of inlet flow rate measurement devices. The second inlet pressure measurement device 66 is arranged and designed to generate a signal $P_{in2}(t)$, which is representative of the pressure in the kill line 54 as a function of time (t). The inlet pressure measurement devices 62, 66 transmit their respective signals $P_{in}(t)$ and $P_{in2}(t)$, preferably in real time, to the central control unit 80, which receives and processes the signals.

Returning to FIG. 1, an outlet pressure measurement device 64, such as a pressure sensor, is disposed in the choke line 56 preferably in proximity to the rig well control choke manifold 86 and upstream of the flow control device 70. The outlet pressure measurement device 64 is arranged and designed to generate a signal $P_{out}(t)$, which is representative of the pressure in the choke line 56 as a function of time (t). When the outlet pressure sensor 64 is disposed upstream of the flow control device 70, the pressure sensor measures pressure representative of the casing pressure (or the choke manifold pressure on floating rigs). The outlet pressure measurement device 64 transmits the signal $P_{out}(t)$ in real time to the central control unit 80, which receives and processes the signal.

In an alternative implementation, as shown in FIG. 3, the outlet pressure sensor 64 is disposed in the proximity of the rig well control choke manifold 86 as described above and a second outlet pressure sensor 68 is disposed downstream of the flow control device 70 in closer proximity to the outlet flow rate measurement device 50. The outlet pressure measurement device 64 is arranged and designed to generate a signal $P_{out}(t)$, which is representative of the pressure in the choke line 56 (i.e., the casing pressure) upstream of the flow control device 70 as a function of time (t). The second outlet pressure sensor 68 is arranged and designed to generate a signal $P_{out2}(t)$, which is representative of the pressure in the choke line 56 downstream of the flow control device 70. The outlet pressure measurement devices 64, 68 transmit their respective signals $P_{out}(t)$ and $P_{out2}(t)$, preferably in real time, to the central control unit 80, which receives and processes the signals.

Using this system, the operator preferably monitors the flow rates in addition to the pressure measurements to confirm that the pressure inside the well bore 12 is maintained between acceptable high and low pressure limits, such as between the pore and fracture pressures of formation 14. This method significantly increases the well control accuracy when compared to methods using a conventional system, in which the operator monitors only the pressure measurements. In addition to confirming that the pressure inside the well bore 12 is between specific limits, the system disclosed herein also controls the pressure to be between such specific limits. This, too, contributes to an increased well control accuracy.

As shown in FIGS. 1-4, an inlet temperature measurement device 76 is disposed in the fluid injection line 48, preferably upstream of the standpipe manifold 84, and an outlet temperature measurement device 78 is disposed in the choke line 56, preferably downstream of the rig well control choke manifold 86, to generate signals $T_{in}(t)$ and $T_{out}(t)$, respectively. The signals, $T_{in}(t)$ and $T_{out}(t)$, from these optional temperature measurement devices 76, 78 are transmitted to the central control unit 80, which is arranged and designed to receive them. The temperature measurement devices 76, 78 may be any device known to those of skill in the art to measure temperature including, but not limited to, thermometers and thermocouples. As is well known in the art, such temperature data may be used to adjust the calculation of fluid properties that are a function of pressure and temperature, such as density and other rheological properties. The fluid property calculations are preferably performed in response to any measured, real time temperature variations of the fluid, thereby improving the accuracy of the overall system 10.

The central control unit 80 is arranged and designed to receive signals generated by the fluid flow rate measurement devices 50, 52, 58, 60, pressure measurement devices 62, 64, 66, 68, and the temperature measurement devices 76, 78. As shown in FIG. 1, the central control unit 80 receives these signals via wired links (shown by dotted lines) coupled between the respective measurement devices 50, 52, 62, 64, 76, 78 and the central control unit 80. FIG. 3 additionally shows that the central control unit 80 receives signals generated by the fluid flow rate measurement device 58 and the pressure measurement device 68. Likewise, FIG. 4 additionally shows that the central control unit 80 receives signals generated by the fluid flow rate measurement device 60 and the pressure measurement device 66. Alternatively, each of the measurement devices may wireless transmit generated signals in any manner known to those skilled in the art, such as by cellular, infrared, or acoustic transmission. In such wireless implementation, the central control unit 80 is arranged and designed to receive and interpret such wireless transmissions.

Figure 5:
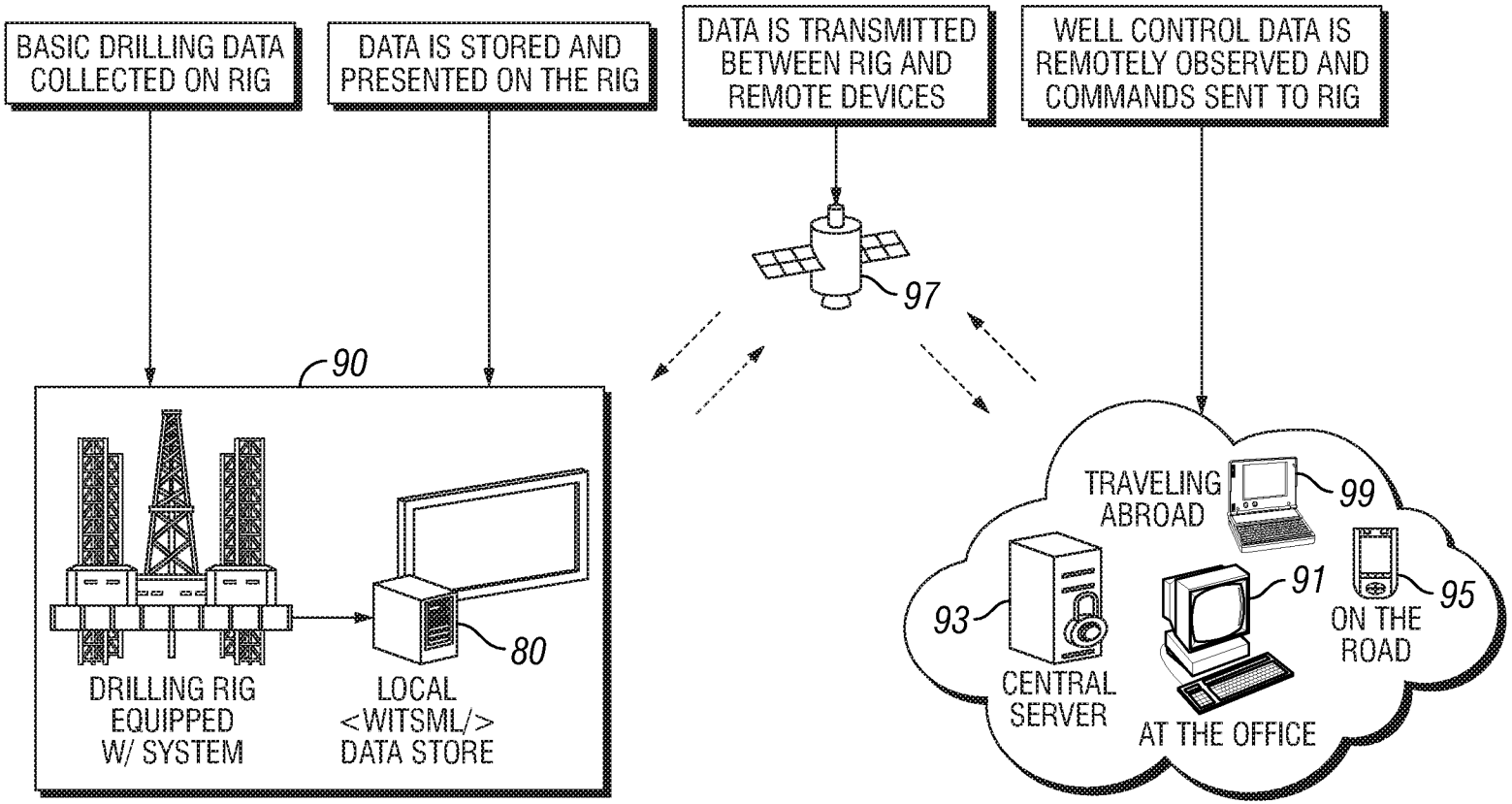
FIG. 5 is an illustration showing that measured and/or calculated data and commands may be transmitted between the central control unit of the rig and remote user interface devices.

As generally shown in FIG. 5, rig data from the central control unit 80 including, but not limited to, received signals (e.g., flow rate, pressure and temperature measurements), computed parameters (e.g., fracture and pore pressures), control signals (e.g., to control the flow through choke line 56 via flow control device 70), etc., may itself be transmitted remotely by establishing a communication link, e.g., via satellite 97, wired connection, and/or wireless connection, etc., between the central control unit 80 of rig 90 and a remote unit, such as another computer 91, 99, storage device 93 (e.g., a server), and/or to a mobile device 95 (e.g., a smart phone). In this way, rig data may be accessed in real time by personnel located remotely from the rig 90. This permits well control experts to interact with and/or guide the rig crew stationed on-site both before and after the conventional BOP 32 has been closed due to detection of the fluid influx event, thereby assisting with the interpretation of the data and directing the best way to maintain or regain control of the well 12. Those skilled in the art will readily recognize that well control experts, while monitoring and/or guiding on-site personnel in the correct well control procedures, may transmit commands (e.g., control signals) to the central control unit 80 and/or to other system components (e.g., flow control device 70, pump 40, etc.), which are responsive to such commands, to regain control of the well. Such remotely transmitted commands may be in conjunction with or may override the actions of the on-site personnel in the well control operations. In an alternative implementation, the flow rate, pressure and temperature signals transmitted by the various measurement devices 50, 52, 58, 60, 62, 64, 66, 68, 76, 78 may be transmitted directly to a remotely located computer 91, 93, 99 or to mobile devices 95, such as smart phones, thereby bypassing any central control unit 80. In such implementation, the remotely located well control experts send commands directly to the flow control device 70, pump 40, and other equipment (e.g., choke line valve 36, kill line valve 34, etc.) to control the well.

As described, the central control unit 80 is arranged and designed to receive measured signals, including signals $T_{in}(t)$, $T_{out}(t)$, $P_{in}(t)$, $P_{out}(t)$, $F_{in}(t)$, and $F_{out}(t)$, and as applicable, signals $P_{in2}(t)$, $P_{out2}(t)$, $F_{in2}(t)$, and $F_{out2}(t)$. Additional parameters, including but not limited to, well bore depth, bit depth (if drilling) or string configuration (if conducting a completion, work-over or intervention), mud properties (i.e., density and rheology) and/or well bore geometry (inclination and direction) are also preferably measured and received by, or inputted by personnel into, the central control unit 80, which uses the data via software 81 (discussed hereinafter) to completely and accurately interpret the state of the well 12 and to assess of the best course of action to regain control of the well 12 before resuming operations. Alternatively, one or more of these parameters may be calculated by software 81 using any data that is available to the central control unit 80.

The central control unit 80 determines, preferably in real time, the annulus pressure at any desired, specific depth within the well bore 12. Using at least received signals $P_{out}(t)$ and $F_{out}(t)$, the central control unit 80 generates signal $P_{ann}(t)$, which is representative of pressure at a specified depth inside the well bore annulus 18 as a function of time (t). Software 81, installed in the central control unit 80, is used by the central control unit 80 to compute the annulus pressure signal, $P_{ann}(t)$, as a function of time (t). The annulus pressure signal, $P_{ann}(t)$, is determined by adding the hydrostatic pressure of the fluid/mud within the well bore annulus 18, the friction pressure generated in the well bore annulus 18 and choke line 56 by any fluid in circulation (i.e., a function of signal $F_{out}(t)$), and the outlet pressure, $P_{out}(t)$, as preferably measured by the outlet pressure measurement device 64.

Figure 6:
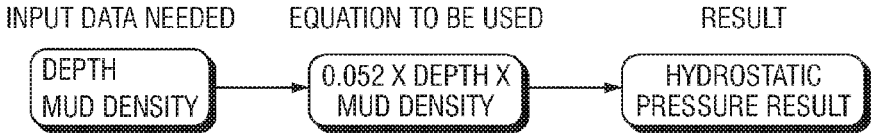
FIG. 6 is a flowchart showing the general procedure for calculating the hydrostatic pressure of well fluid at a specified well depth.
Figure 7:
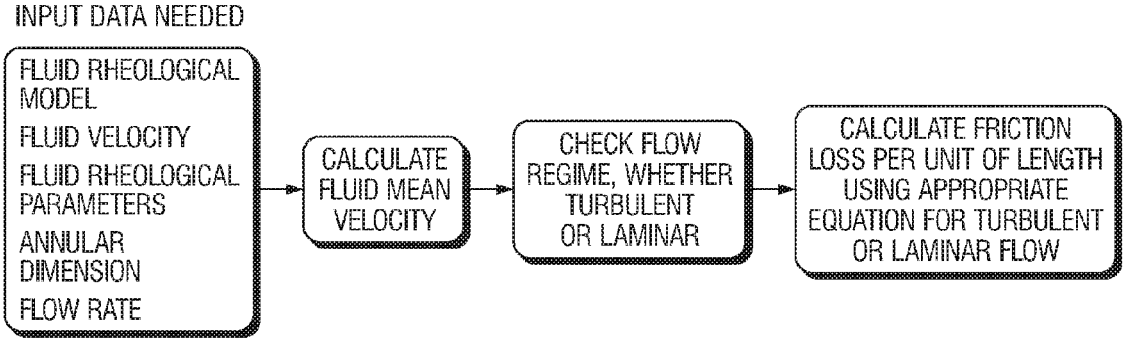
FIG. 7 is a flowchart showing the general procedure for calculating the friction loss/pressure of fluid circulating through the well bore annulus.

The software 81 calculates the hydrostatic pressure based on a number of parameters including, but not limited to, the density of the fluid in the well bore 12 and the depth at which the hydrostatic pressure is to be determined. FIG. 6 provides a simple flowchart showing how the hydrostatic pressure may be calculated. Software 81 also calculates the friction loss in the annulus 18 generated by any circulating fluid based on a number of parameters including, but not limited to, the velocity of the fluid flow (i.e., a function of signal $F_{out}(t)$), density and rheological parameters of the fluid flow, and the geometry of the annulus 18 and choke line 56. FIG. 7 provides a simple flowchart showing how the annular friction loss/pressure may be calculated. Software 81 also includes the necessary correlations to adjust the calculation of fluid properties in response to any temperature variations of the fluid, as measured and transmitted, preferably in real time, by the temperature measurement devices 76, 78 to the central control unit 80. Other parameters, including but not limited to, the flow rate $F_{in}(t)/F_{in2}(t)$ into the well bore 12, the inlet pressure $P_{in}(t)/P_{in2}(t)$, the depth of the well bore 12, and the density of the fluid/mud pumped into the well bore 12 may also be employed by software 81 in computing the signal $P_{ann}(t)$.

Software 81 preferably calculates the hydrostatic pressure and friction losses based on hydraulic equations developed over the past several decades, which are well known to those skilled in the art. Examples of such hydraulic equations traditionally used in oil and gas operations to determine the pressure at any depth in the well bore 12 may be found in, for example, Adam T. Bourgoyne, et al., Applied Drilling Engineering 113-189 (SPE Textbook Series 1986), which is incorporated herein by reference.

The following is an example of how the annulus pressure at a specified well depth may be calculated by software 81 using well known hydraulic equations and typically available rig data. This example is provided by way of illustration only and is not intended to limit the scope of the system or method of the invention in any way.

Example

The annulus pressure at a well bore depth of 10,000 feet in the well bore annulus between a 3 inch ID pipe and 5 inch ID pipe is to be determined. A Newtonian fluid having a density of 9.0 pounds per gallon is being circulated through the well bore at a flow rate of 100 gallons per minute. The backpressure being applied to the well bore annulus is 200 psi, as measured by the outlet pressure measurement device. The $\Theta_{300}$ rheological parameter of the fluid is 30 (i.e., $\mu$=30 cp; the viscosity in centipoise). As previously discussed, the annulus pressure is determined by adding the hydrostatic pressure of the fluid/mud within the well bore annulus, the friction loss/pressure generated in the well bore annulus, and choke line if applicable, by any fluid in circulation, and the outlet pressure (i.e., backpressure applied to the well bore). The hydrostatic component of the annulus pressure is determined as the product of the equation, 0.052*(depth)*(density), which based on the above data, equals 4,680 psi. The friction loss component of the annulus pressure requires the determination of the fluid mean velocity, the turbulence criteria, and the frictional pressure loss per foot. Based on the above data, the fluid mean velocity in the annulus equals 2.55, which is the product of the equation, $[(\text{flow rate})]/[2.448*(d_2^2-d_1^2)]$, where $d_2$ is the inner diameter and $d_1$ is the outer diameter. The turbulence criteria is determined from the Reynolds number, $N_{Re}$, which for flow through an annulus is the product of the equation, [757*density*fluid mean velocity*$(d_2-d_1)$]/[μ]. Based on the above data, the Reynolds number is 1,158, which is representative of laminar flow (i.e., $N_{Re}$ less than 2,100). The frictional loss per foot is determined using the laminar flow equation, dP/dL=[μ*(fluid mean velocity)]/[1000*$(d_2-d_1)^2$]. Thus, the laminar flow frictional loss per foot, dP/dL, is equal to 0.019 psi/ft. The total laminar flow frictional loss for the 10,000 foot well depth is simply the product of 0.019 psi/ft*10,000 ft, or 191.25 psi. Finally, the backpressure being applied to the well bore annulus is 200 psi, as directly measured by the outlet pressure measurement device. The annulus pressure is determined by summing the hydrostatic component, the frictional loss component and the backpressure component, i.e., 4,680+191+200. Thus, based on the given data, the annulus pressure at a well depth of 10,000 feet is equal to 5,071 psi.

The formation fracture pressure and the formation pore pressure may be pre-determined or estimated boundary values that are manual inputs to the software 81 of the central control unit 80. More preferably, the central control unit 80 uses the flow rate, pressure, and temperature signals received from the respective measurement devices to determine an accurate pore pressure and fracture pressure of the formation 14. The formation pore pressure is determined after a fluid influx from the formation 14 into the well bore annulus 18 is detected/suspected and after the conventional BOP 32 is closed. As hereinafter described in greater detail, the pore pressure is determined by reducing in stages the backpressure, initially applied to stop the influx after the BOP 32 is closed, until an influx is detected by monitoring flow rates into and out of the well bore 12.

The fracture pressure of the formation 14 is preferably determined through a "leak-off test" before starting operations or at any time after an operation is started. While drilling, a "leak-off test" is performed for purposes of determining the fracture initiation pressure for the next segment of the well bore 12 to be drilled. In a typical "leak-off test," the well bore annulus 18 is sealed off or closed from atmosphere by closing a conventional BOP 32 and by fully closing the choke 70 disposed in the rig well control choke manifold 86. Fluid/mud is introduced into the borehole 12 at a relatively slow and constant volumetric rate through the fluid injection line 48 and the central passageway of the drill string 20 so that the fluid/mud exits the drill string 20 through the drill bit 26 and enters the well bore annulus 18, which is sealed off by the closed choke 70 at the surface. As this flow into the well bore 12 continues, the pressure in the annulus 18 increases linearly until such time that the formation 14 starts to absorb fluid. At this point, a change in the slope of the pressure curve versus volume injected occurs. Many drilling companies consider this point to represent the leak-off or fracture pressure of the open hole section 12. While a determination of the fracture pressure would appear straight forward, there are several additional methods of conducting a leak-off test, and a standard method may not be used even within the same drilling company. This variation in procedures and ways of interpreting when the fluid starts to leak to the formation 14 is one of the causes of well problems and non-productive time, each resulting in a significant waste of resources.

Using system 10 with the BOP 32 closed, the leak-off test is preferably conducted using a constant injection flow rate through the drill string 20 with the return flow up the well annulus 18 and through the choke line 56 with the choke 70 fully open. The casing pressure (i.e., the backpressure applied to the borehole annulus 18) is increased slowly and in stages (e.g., incrementally) by closing the choke 70 accordingly while monitoring the fluid flow rate out of the well annulus 18 via at least one of outlet fluid flow rate measurement devices 50, 58. The casing pressure is increased slowly, because a more accurate determination of the fracture pressure is obtained when smaller step changes in casing pressure are made during the leak-off test. With the increase in pressure, the flow rate out of the well annulus 18 is initially reduced due to the compressibility of the system. However, if there are no fluid losses to the formation 14, then after the system reaches steady state, the fluid flow rate out of the well bore annulus 18 through the choke line 56 will equilibrate to the fluid flow rate into the well bore annulus 18 through the drill string 20 (or kill line 54). An additional increase in casing pressure is effected by closing the choke 70 slightly while monitoring fluid flow rate into and out of the well bore 12.

As described above, the software 81 of the central control unit 80 calculates the annulus pressure signal, $P_{ann}(t)$, at a specified well depth as a function of time (t). The formation fracture pressure is simply the annulus pressure, $P_{ann}(t)$, at the depth of the fluid loss at a time, $t_{frac}$, when the flow rate out of the well bore annulus 18 first starts/begins to no longer equal or approximate the flow rate into the well bore 12, thereby maintaining a steady state loss of fluid into the well bore 12 (i.e., when flow rate into the well bore 12, as represented by signal $F_{in}(t)$, first becomes consistently greater than flow rate out of the well bore 12, as represented by signal $F_{out}(t)$). Thus, the formation fracture pressure, like the annulus pressure, is a function of the hydrostatic pressure, the casing pressure being applied as preferably measured by the outlet pressure measurement device 64 (i.e., signal $P_{out}(t)$) and the friction loss in the well bore annulus 18 and choke line 56 generated by the circulating fluid (i.e., a function of signal $F_{out}(t)$), as preferably estimated by the hydraulic model incorporated into software 81. Because the fluid flow rate used in the leak-off test is low, the corresponding friction loss in the annulus 18 and choke line 56 generated by the circulating fluid is also low, thereby reducing estimation uncertainty and increasing the accuracy of the formation fracture pressure determination.

A preferred implementation of the method of the invention provides for safe well control while the conventional BOP 32 is closed in response to a detected or suspected kick (i.e., fluid influx). During normal drilling operations, a drill string turning device 38, turns an upper end 24 of a drill string 20 in a borehole 12. The drill string 20 has a drill bit 26 at a lower end 22 which contacts the bottom of the borehole 12. As the drill string 20 is turned, the drill bit 26 penetrates the subterranean formation 14 thereby increasing the depth of the borehole 12 and creating a well bore annulus 18 between an outer diameter of the drill string 20 and an inner diameter of the borehole 12. While drilling, a fluid or mud is pumped from a surface fluid reservoir 42 by a conventional surface fluid/mud pump 40 through a fluid injection line 48, through a central passageway of the drill string 20, out nozzles in the drill bit 26 and into the well bore annulus 18. Continued injection of the fluid into the well bore annulus 18 causes the fluid to pick up cuttings from the penetration of the subterranean formation 14 by the drill bit 26 and move them up the well bore annulus 18 and through a fluid return line (not shown). The fluid return line carries the fluid/mud with cuttings to a shale shaker 44 to remove the cuttings from the fluid/mud. The cleaned fluid/mud is then returned to the surface fluid reservoir 42 for reuse.

As the drill bit 26 penetrates into deeper subterranean formation zones, the formation pressure may increase or decrease. A zone in the subterranean formation 14 may be encountered in which the formation pressure is greater than the hydrostatic and/or dynamic pressure provided by the fluid/mud in the well bore annulus 18. In such case, a kick or fluid influx may occur.

Upon detection or suspicion of a fluid influx, a preferred well control procedure is to stop drilling (i.e., stop the rotation/turning of the drill string 20/drill bit 26 and stop the circulation of fluid by ceasing the operation of fluid pump 40 and closing the flow control device 70 to permit no fluid flow therethrough), close the conventional BOP 32, and allow the standpipe and casing pressures at the surface to stabilize. After stabilizing the well bore pressure, the preferred next steps are to ascertain the hydrostatic condition of the well bore 12, confirm the suspected fluid influx (i.e., confirm that the well bore 12 is in a condition in which existing mud hydrostatic pressure is less than the pressure in an exposed, producing formation), determine the formation pore pressure, and determine the correct fluid/mud weight that should be circulated through the well bore 12 to regain control of the well, with all steps preferably performed using central control unit 80 and software 81.

Since software 81 is preferably employed to control choke 70 to maintain the pressure in choke line 56 at specific, selected values, a preferred method of ascertaining the hydrostatic condition of the well bore 12 involves operating fluid pump 40 to circulate fluid at a constant flow rate. This action is followed by reducing the casing pressure in small step changes (i.e., incrementally) by opening the choke 70 in corresponding step changes while monitoring the flow rate of fluid out of the well bore 12 through the choke line 56 (as well as the flow rate into the well bore 12, which is preferably constant). Opening the choke 70 reduces the backpressure applied to the borehole annulus 18. In contrast to the leak-off test procedure previously described, the flow rate of fluid out of the well bore 12 will increase after the casing pressure is reduced. Further, if the well is dynamically overbalanced, the flow rate of fluid out of the well bore 12 soon equilibrate to the flow rate of fluid into the well bore 12. Subsequent reductions in the casing pressure (i.e., a greater fluid flow rate through flow control device 70) eventually induce the well 12 into becoming dynamically underbalanced (i.e., flow rate into the well bore represented by signal $F_{in}(t)$ becoming smaller or less than flow rate out of the well bore 12 represented by signal $F_{out}(t)$). The underbalanced condition is confirmed by the flow rate out of the well bore 12 (i.e., represented by signal $F_{out}(t)$) remaining consistently higher or greater than the flow rate into the well bore 12 (i.e., represented by signal $F_{in}(t)$) after steady state is achieved following the previous reduction in casing pressure. As further confirmation, the casing pressure may be immediately increased to the previous higher value, by reducing fluid flow rate through flow control device 70, such that the flow rate $F_{in}(t)$ or $F_{in}(t)$ into the well bore 12 substantially equals the flow rate $F_{out}(t)$ out of the well bore 12. The formation pore pressure is simply the annulus pressure, $P_{ann}(t)$, at the depth of the fluid influx at a time, $t_{pore}$, when the flow rate out of the well bore annulus 18 first starts/begins to no longer equal or approximate the flow rate into the well bore 12, thereby maintaining a steady state gain of fluid into the well bore 12 (i.e., when flow rate into the well bore 12, as represented by signal $F_{in}(t)$, first becomes consistently less than flow rate out of the well bore 12, as represented by signal $F_{out}(t)$). As described above, the software 81 of the central control unit 80 generates the annulus pressure signal, $P_{ann}(t)$, at a specified well depth as a function of time (t). Thus, the formation pore pressure, like the annulus pressure, is a function of the hydrostatic pressure, the casing pressure being applied as preferably measured by the outlet pressure measurement device 64 (i.e., signal $P_{out}(t)$) and the friction loss in the well bore annulus 18 and choke line 56 generated by the circulating fluid (i.e., a function of signal $F_{out}(t)$), as preferably estimated by the hydraulic model incorporated into software 81.

If the casing pressure cannot be reduced sufficiently to create a dynamically underbalanced condition by fully opening the choke 70, then the fluid/mud pump 40 is adjusted to reduce the flow rate of fluid pumped into the well bore 12. The fluid flow rate out of the well 12 is subsequently monitored as described above. If the fluid pump 40 is off and the well 12 is not hydrostatically underbalanced, it is an indication that a false kick alarm, or a very small pocket of pressurized fluid fully depleted by the influx that entered the well bore, triggered the BOP 32 closed by the rig crew. Thus, there may be no need to increase the weight of the fluid inside the well bore 12 before resuming operations.

After the conventional BOP 32 is closed in response to a detected fluid influx, the hydrostatic condition of the well has been confirmed to be underbalanced, and the pore pressure of the formation 14 is determined, fluid is pumped into the well bore annulus 18 via the drill string 20 and/or the kill line 54 to circulate the fluid influx out of the well bore 12 through the choke line 56. However, depending on the condition of the well at the time BOP 32 is finally closed by the rig crew, circulation of the influx out of the well bore 12 may be performed before confirming the hydrostatic condition of the well 12 to be underbalanced and/or before the pore pressure of the formation 14 is determined. The fluid pumped into the well bore annulus 18 and the formation fluid (i.e., influx fluid) entering, or that has entered, the well bore annulus 18 from the formation 14 flow through the choke line 56 to the separator 46 and then to surface fluid reservoir 42. An increasingly heavier weight fluid/mud may be circulated through the well bore 12 until the formation pressure is equalized by the hydrostatic pressure of the fluid/mud. Preferably, however, the circulation of the heavier fluid is done after the well is confirmed to be hydrostatically underbalanced and the formation pore pressure is determined, as described above. In this way, the correct weight of the heavier fluid weight may be readily determined, e.g., by software 81, as a weight that will provide a hydrostatic fluid pressure greater than the previously determined pore pressure. The correct weight of the heavier fluid weight is then circulated through the well 12 to hydrostatically balance the well 12 to a well bore/annulus pressure greater than the previously determined pore pressure but less than the previously determined fracture pressure.

Circulation of the fluid/mud through well bore 12 is indirectly and preferably controlled by the flow control device 70 disposed in the choke line 56 and/or by the pumping action of pump 40. The central control unit 80 controls the flow control device 70 to increase or decrease the flow rate through the choke line 56, thereby decreasing or increasing, respectively, the backpressure on the well bore annulus 18. Alternatively, the flow control device 70 may be controlled manually by the operator to increase or decrease the flow rate through the choke line 56, thereby controlling the backpressure applied to the well bore annulus 18. As previously stated, the signal $P_{out}(t)$ is representative of pressure within the choke line 56, and particularly, the outlet pressure applied to the well bore 12 (i.e., backpressure or casing pressure), when the outlet pressure measurement device 64 is disposed upstream of the flow control device 70.

Alternatively, the central control unit 80 may control the speed or pumping capacity of the pump 40 to either increase or decrease the flow rate of fluid/mud pumped into the well bore 12. In this way, the pump 40 controls the pressure at which the fluid/mud is delivered to the well bore 12. As previously stated, the signal $P_{in}(t)$ is representative of the pressure (i.e., standpipe pressure) of the fluid pumped into the well bore 12 through the fluid injection line 48, and particularly, the inlet pressures applied to the well bore 12 through the drill string 20. Likewise, the signal $P_{in2}(t)$ is representative of the pressure (i.e., standpipe pressure) of the fluid pumped into the well bore 12 through the kill line 54, and particularly the inlet pressure applied to the well bore 12 through the kill line 54.

Based upon the pore pressure and fracture pressure (or other specified upper and lower pressure limits), and preferably while measuring and/or calculating pressures, flow rates, and temperatures into and out of the well bore 12 as well as other well parameters, including signal $P_{ann}(t)$, the software 81 of central control unit 80 generates a signal, FC(t), which is transmitted preferably in real time to the flow control device 70. The flow control device 70 is arranged and designed to receive the signal FC(t) and to adjust the fluid flow through the flow control device 70 according to the signal. For instance, a signal FC(t) increasing the choke line flow rate will reduce the backpressure applied to the well 12 and thus decrease the pressure in the annulus 18. Conversely, a signal FC(t) decreasing the choke line flow rate will increase the backpressure applied to the well 12 and thus increase the pressure in the annulus 18. Thus, adjusting the fluid flow through the flow control device 70 adjusts the backpressure applied to the well 12 so as to maintain the pressure in the well bore 12, as determined preferably in real time by generated signal $P_{ann}(t)$, between the previously determined (or predetermined/set point) fracture and pore pressures of the formation 14. Signal FC(t) is representative of either the choke line flow rate or pressure required to maintain the well annulus pressure below the formation fracture pressure and above the formation pore pressure, as a function of time. Whether the signal FC(t) is representative of choke line flow rate or choke line pressure depends on whether flow rate or pressure is the basis of the well control procedure.

The logic used to determine the signal, FC(t), is based on conventional well control theory, e.g., as referenced in David Watson et al., Advanced Well Control (SPE Textbook Series, 1986) and incorporated herein by reference. An example of this logic is to maintain the surface casing pressure, $P_{out}(t)$, constant while changing the speed of pump 40. Another example of this logic involves maintaining the standpipe pressure, $P_{in}(t)$, constant while circulating out the influx fluid.

Alternatively, signal, FC(t), may involve hydraulics calculations performed by software 81 of the central control unit 80 concurrent with, and utilizing real-time measurements from the various measurement devices referenced previously, including but not limited to, outlet pressure measurement device (choke pressure gauge) 64, outlet flow rate measurement device (choke line pressure gauge) 50, 58, inlet pressure measurement device (standpipe pressure gauge) 62, inlet flow rate measurement device 52, etc. An example of such hydraulics calculation usage employs the hydraulics model calibrated during drilling operations just prior to a fluid influx into the well bore 12. Using such hydraulics model, the software 81 calculates the pressure at a specific point in the annulus 18, $P_{ann}(t)$, (e.g., at the "weak point" below the casing shoe) using hydraulics modeling of friction losses in the drill string 20, through the nozzles of the drill bit 26, and between the drill bit 26 and the specific point in the annulus 18. This calculated annular pressure, $P_{ann}(t)$, which predictably decreases during a conventional kill operation, provides feedback/input to software 81, which may then be used (e.g., compared to a desired, specific value or to upper/lower limits, such as for fracture/pore pressure) in generating signal FC(t) to automatically control flow control device 70 to apply more or less backpressure to the well 12, as previously disclosed. Using this method, signal $P_{ann}(t)$ is maintained between specific limits, e.g., between the fracture and pore pressures, or driven toward a desired, specific value for any given time, t. A settling time between flow control device 70 adjustments may be programmed into the software 81, or otherwise instituted, in order to permit pressure in the annulus 18 to reach steady state.

In a preferred implementation, the central control unit 80 controls, and preferably maintains a substantially constant value for, the annulus pressure $P_{ann}(t)$ at a particular well bore depth by driving the annulus pressure signal $P_{ann}(t)$ toward a desired value between the fracture pressure and the pore pressure to avoid fracturing the formation (i.e., when the well bore pressure is above the fracture pressure) or causing a secondary influx (i.e., when the well bore pressure is below the pore pressure). The annulus pressure signal $P_{ann}(t)$ is driven toward the desired value through control of flow control device 70 via signal FC(t), as previously disclosed. Signal FC(t) is generated such that the difference between annulus pressure signal $P_{ann}(t)$ at any time (t) and the desired, specified annulus pressure is driven toward zero or near zero. Therefore, while the conventional BOP 32 is closed and the fluid influx is being circulated out of the well bore, the central control unit 80 in combination with the flow control device 70 controls the well 12 and maintains the pressure inside the well bore annulus 18 below the formation fracture pressure but above the formation pore pressure. Alternatively, the operator, while viewing the flow rate and pressure data received from the various measurement devices via the central control unit 80, may control the choke 70 manually to ensure that the generated signal $P_{ann}(t)$, representative of pressure at a certain depth inside the well bore annulus 18 as a function of time (t), is maintained between the fracture and pore pressures of the formation 14.

Thus, in a preferred implementation of the method of the invention, the well 12 is safely controlled after the conventional BOP 32 is closed in response to a suspected fluid influx event by ascertaining the hydrostatic condition of the well bore 12, confirming the suspected fluid influx, determining the pore and fracture pressures of the formation 14, determining the correct fluid/mud weight that should be circulated through the well bore 12, circulating the fluid influx out of the well through the choke line 56, and circulating the heavier fluid into the well 12 and annulus 18 while monitoring all measured parameters and controlling the choke line choke 70 to maintain the annulus pressure between the fracture pressure and the pore pressure of the formation 14.

While the system 10 and method are described herein as being used in real time during actual oil and/or gas operations, the system 10 and method may also be employed off-line to provide a safe opportunity for crews to manually perform the same operational well control sequences, thereby confirming crew competency or providing highly relevant remedial well control training. Thus, the system 10 is used to train the rig personnel/crew in understanding the proper procedures to be implemented in response to well control events, such as when the conventional BOP 32 is closed upon detection of a fluid influx event. In the off-line mode and at unannounced times when well and drilling conditions permit interruption of operations without undue risk, well control experts may send commands (e.g., control signals) and/or data to the central control unit 80 to implement off-line well control event training scenarios/models that utilize actual well and drilling equipment conditions as the basis for the training exercise. In this way, remotely located well control experts may test and train rig crews in the performance of well control techniques in response to simulated rig operations occurring before, during, and after a well control event, such as a fluid influx. In addition to establishing the conditions relevant to the training objectives in a realistic, but controlled, manner, the system will record, in real time, the actual valve actuations, pump operations, pressure adjustments, etc. that reflect the competency of the crew in relation to well control performance objectives. As generally shown in FIG. 5 and as discussed previously, rig data/parameters received by and/or calculated by the central control unit 80 may be transmitted to remote units (e.g., remote computers, mobile devices, etc.) for observation and/or review by well control experts conducting such training exercises, or monitored and assessed directly on the rig 90 by the rig crew supervisors. Review and replay of the response sequences provides heretofore unobtainable data to confirm crew competencies and/or deficiencies while using actual rig equipment under field operational, rather than test, conditions. An advantage to such testing and training is that the rig crew responds to simulated well control events using the same system 10 and method described herein, which are the same system 10 and method that would be preferably used during normal operation or during an actual well control event. Thus, the use of the same system 10 and method that is actually used on the rig 90 for testing and training provides an invaluable opportunity for rig crew training and competency assessments.

The Abstract of the disclosure is written solely for providing the U.S. Patent and Trademark Office and the public at large with a means by which to determine quickly from a cursory inspection the nature and gist of the technical disclosure, and it represents one preferred implementation and is not indicative of the nature of the invention as a whole.

While some implementations of the invention have been illustrated in detail, the invention is not limited to the implementations shown; modifications and adaptations of the disclosed implementations may occur to those skilled in the art. Such modifications and adaptations are in the spirit and scope of the invention as set forth herein:

What is claimed is:

1. A system (10) for controlling a well being drilled into a subterranean formation (14), said system comprising, a tubular drill string (20) having a lower end (22) extending into a borehole (12) and an upper end (24), said tubular drill string having a drill bit (26) at a lower end, a drill string turning device (38) arranged and designed to turn said drill bit in said borehole in which a borehole annulus (18) is defined between an outer diameter of said tubular drill string and an inner diameter of said borehole, a blow-out preventer (32) arranged and designed to close said borehole from atmosphere only at a time when said drill bit is stationary, a fluid pump (40) in fluid communication with a surface fluid reservoir (42), a choke line (56) coupled between said borehole annulus and said surface fluid reservoir and arranged and designed to permit fluid communication therebetween when said blow-out preventer closes said borehole from atmosphere, a fluid injection line (48) extending between said fluid pump and said upper end of said drill string, said fluid injection line capable of providing fluid communication therebetween, said fluid injection line, said drill string, said borehole annulus and said choke line defining a fluid pathway when said blow-out preventer closes said borehole from atmosphere, an outlet flow rate measurement device (50) disposed in said choke line, said outlet flow rate measurement device arranged and designed to measure flow rate through said choke line and to generate a signal $F_{out}(t)$ representative of actual choke line flow rate as a function of time (t), an outlet pressure measurement device (64) disposed in said choke line, said outlet pressure measurement device arranged and designed to measure choke line pressure and to generate a signal $P_{out}(t)$ representative of actual choke line pressure as a function of time (t), a central control unit (80) arranged and designed, while said borehole is closed from atmosphere by said blow-out preventer, to receive said signals $F_{out}(t)$ and $P_{out}(t)$, to determine a formation fracture pressure as a function of said signals $F_{out}(t)$ and $P_{out}(t)$, to determine a formation pore pressure as a function of said signals $F_{out}(t)$ and $P_{out}(t)$, to generate a signal $P_{ann}(t)$ representative of pressure at a desired well bore depth as a function of time (t), to generate a signal FC(t) representative of choke line flow rate required as a function of time (t) to maintain said signal $P_{ann}(t)$ below said formation fracture pressure and above said formation pore pressure, and to transmit said signal FC(t), and a flow control device (70) disposed in said choke line, said flow control device arranged and designed to control fluid flow therethrough in response to said signal FC(t) transmitted and received from said central control unit, thereby controlling choke line flow rate to maintain said signal $P_{ann}(t)$ below said formation fracture pressure and above said formation pore pressure.

2. The system of claim 1 further comprising, an inlet flow rate measurement device (52) disposed in said fluid injection line, said inlet flow rate measurement device arranged and designed to measure fluid flow rate through said fluid injection line and to generate a signal $F_{in}(t)$ representative of actual fluid injection line flow rate as a function of time (t).

3. The system of claim 2 wherein, said central control unit is further arranged and designed to receive said signal $F_{in}(t)$ and to determine said formation pore pressure as a function of said signals $F_{out}(t)$ and $P_{out}(t)$ when said flow control device controls fluid flow rate through said choke line such that said signal $F_{in}(t)$ first becomes consistently less than said signal $F_{out}(t)$.

4. The system of claim 2 wherein, said central control unit is further arranged and designed to receive said signal $F_{in}(t)$ and to determine said formation fracture pressure as a function of said signals $F_{out}(t)$ and $P_{out}(t)$ when said flow control device controls fluid flow rate through said choke line such that said signal $F_{in}(t)$ first becomes consistently greater than said signal $F_{out}(t)$.

5. The system of claim 1 further comprising, an inlet pressure measurement device (62) disposed in said fluid injection line, said inlet pressure measurement device arranged and designed to measure fluid injection line pressure and to generate a signal $P_{in}(t)$ representative of actual fluid injection line pressure as a function of time (t), and wherein, said central control unit is further arranged and designed to receive said signal $P_{in}(t)$.

6. The system of claim wherein, said central control unit is further arranged and designed to calculate an increase in fluid weight to be pumped through said fluid pathway based upon said formation pore pressure.

7. The system of claim 1 further comprising, a kill line (54) coupled between said fluid pump and said borehole annulus and capable of providing fluid communication therebetween, and wherein, said kill line, said borehole annulus, and said choke line define said fluid pathway when said blow-out preventer closes said borehole from atmosphere.

8. The system of claim 7 further comprising, an inlet flow rate measurement device (60) disposed in said kill line, said inlet flow rate measurement device arranged and designed to measure fluid flow rate through said kill line and to generate a signal $F_{in2}(t)$ representative of actual kill line flow rate as a function of time (t).

9. The system of claim 8 wherein, said central control unit is further arranged and designed to receive said signal $F_{in2}(t)$ and to determine said formation pore pressure as a function of said signals $F_{out}(t)$ and $P_{out}(t)$ when said flow control device controls fluid flow rate through said choke line such that said signal $F_{in2}(t)$ first becomes consistently less than said signal $F_{out}(t)$.

10. The system of claim 8 wherein, said central control unit is further arranged and designed to receive said signal $F_{in2}(t)$ and to determine said formation fracture pressure as a function of said signals $F_{out}(t)$ and $P_{out}(t)$ when said flow control device controls fluid flow rate through said choke line such that said signal $F_{in2}(t)$ first becomes consistently greater than said signal $F_{out}(t)$.

11. The system of claim 7 further comprising, an inlet pressure measurement device (62) disposed in said kill line, said inlet pressure measurement device arranged and designed to measure kill line pressure and to generate a signal $P_{in2}(t)$ representative of actual kill line pressure as a function of time (t), and wherein, said central control unit is further arranged and designed to receive said signal $P_{in2}(t)$.

12. The system of claim 7 wherein, said central control unit is further arranged and designed to calculate an increase in fluid weight to be pumped through said fluid pathway based upon said formation pore pressure.

13. The system of claim 1 further comprising, a communication link (97) between said central control unit and a remote unit (91, 93, 95, 99) to transmit rig data from said central control unit to said remote unit for observation of said rig data by well control experts.

14. The system of claim 1 wherein, said central control unit is further arranged and designed to simulate a well control event whereby rig personnel respond to said well control event by implementing well control procedures using said system.

15. The system of claim 1 wherein, said signal FC(t) is representative of choke line pressure required as a function of time (t) to maintain said signal $P_{ann}(t)$ below said formation fracture pressure and above said formation pore pressure and said flow control device controls choke line pressure to maintain said signal $P_{ann}(t)$ below said formation fracture pressure and above said formation pore pressure.

16. A well control system comprising, a blow-out preventer (32) arranged and designed to close a well bore annulus (18) from atmosphere only at a time when drilling is ceased, a choke line (56) coupled between said well bore annulus and a surface fluid reservoir (42), an outlet flow rate measurement device (50) disposed in said choke line, said outlet flow rate measurement device arranged and designed to measure flow rate through said choke line and to generate a signal $F_{out}(t)$ representative of actual choke line flow rate as a function of time (t), an inlet flow rate measurement device (52) disposed in an inlet line (48, 54) coupled between a fluid pump (40) and said well bore annulus, said inlet flow rate measurement device arranged and designed to measure fluid flow rate through said inlet line and to generate a signal $F_{in}(t)$ representative of actual inlet line flow rate as a function of time (t), an outlet pressure measurement device (64) disposed in said choke line, said outlet pressure measurement device arranged and designed to measure choke line pressure and to generate a signal $P_{out}(t)$ representative of actual choke line pressure as a function of time (t), a central control unit arranged and designed, while said blow-out preventer closes said well bore annulus from atmosphere, to receive said signal $F_{out}(t)$, $F_{in}(t)$ and $P_{out}(t)$, to generate a signal $P_{ann}(t)$ representative of pressure at a desired well bore depth as a function of time (t) and to generate and transmit a signal FC(t) representative of choke line pressure required as a function of time (t) to drive said signal $P_{ann}(t)$ toward a desired value, and a flow control device (70) disposed in said choke line, said flow control device responsive to said signal FC(t) and arranged and designed to control fluid flow therethrough, thereby controlling choke line pressure to drive said signal $P_{ann}(t)$ toward said desired value.

17. The well control system of claim 16 wherein, said central control unit is further arranged and designed to receive said signal $F_{in}(t)$ and to determine a formation pore pressure as a function of said signals $F_{out}(t)$ and $P_{out}(t)$ when said flow control device controls fluid flow rate through said choke line such that said signal $F_{in}(t)$ first becomes consistently less than said signal $F_{out}(t)$.

18. The well control system of claim 17 wherein, said central control unit is further arranged and designed to determine a formation fracture pressure as a function of said signals $F_{out}(t)$ and $P_{out}(t)$ when said flow control device controls fluid flow rate through said choke line such that said signal $F_{in}(t)$ first becomes consistently greater than said signal $F_{out}(t)$.

19. The well control system of claim 18 wherein, said desired value of said signal $P_{ann}(t)$ is between said formation pore pressure and said formation fracture pressure.

20. The well control system of claim 16 further comprising, a communication link (97) between said central control unit and a remote unit (91, 93, 95, 99) to transmit rig data from said central control unit to said remote unit for observation of said rig data by well control experts.

21. The well control system of claim 16 wherein, said central control unit is further arranged and designed to simulate a well control event whereby rig personnel respond to said well control event by implementing well control procedures using said system.

22. The well control system of claim 16 wherein, said signal FC(t) is representative of choke line flow rate required as a function of time (t) to drive said signal $P_{ann}(t)$ toward said desired value and said flow control device controls choke line flow rate to drive said signal $P_{ann}(t)$ toward said desired value.

23. A method for controlling a well being drilled into a subterranean formation (14), said method comprising the steps of, turning a tubular drill string (20) that extends into a borehole (12), said tubular drill string having an upper end (24) and a lower end (22) and a drill bit (26) disposed at said lower end, stopping said turning of said tubular drill string when a fluid influx is detected entering said borehole, closing a blow-out preventer (32), said blow-out preventer arranged and designed to close said borehole from atmosphere only at a time when said drill bit is stationary, operating a fluid pump (40) to pump a fluid from a surface fluid reservoir (42) through a fluid injection line (48), into and through said tubular drill string, out said drill bit and into a borehole annulus (18), said borehole annulus created between an outer diameter of said tubular drill string and an inner diameter of said borehole by said turning of said drill string and said drill bit in said borehole, operating a flow control device (70) disposed in a choke line (56), said choke line coupled between said borehole annulus and said surface fluid reservoir and arranged and designed to permit fluid communication therebetween in cooperation with said flow control device while said blow-out preventer closes said borehole from atmosphere, said fluid injection line, said tubular drill string, said borehole annulus, and said choke line defining a fluid flow path through said borehole, measuring actual outlet flow rate of fluid flowing through said choke line while said borehole is closed from atmosphere using an outlet flow measurement device (50) disposed in said choke line and arranged and designed to generate a signal $F_{out}(t)$ representative of actual choke line fluid flow rate as a function of time (t), measuring actual outlet pressure in said choke line while said borehole is closed from atmosphere using an outlet pressure measurement device (64) disposed in said choke line and arranged and designed to generate a signal $P_{out}(t)$ representative of actual choke line pressure as a function of time (t), transmitting said actual outlet flow rate signal $F_{out}(t)$ and said actual outlet pressure signal $P_{out}(t)$ to a central control unit (80), said central control unit arranged and designed to receive said signals, to determine a formation fracture pressure, to determine a formation pore pressure, to generate a signal $P_{ann}(t)$ representative of pressure at a well bore depth as a function of time (t), and to generate a signal FC(t) representative of choke line flow rate required as a function of time (t) to maintain said signal $P_{ann}(t)$ below said formation fracture pressure and above said formation pore pressure, receiving said signal $F_{out}(t)$ and said signal $P_{out}(t)$ in said central control unit, using said central control unit to determine said formation fracture pressure as a function of said signals $F_{out}(t)$ and $P_{out}(t)$, using said central control unit to determine said formation pore pressure as a function of said signals $F_{out}(t)$ and $P_{out}(t)$, using said central control unit to generate said signal $P_{ann}(t)$, using said central control unit to generate said signal FC(t), transmitting said signal FC(t) to said flow control device, said flow control device arranged and designed to receive said signal FC(t), receiving said signal FC(t) in said flow control device, said flow control device further arranged and designed to control fluid flow through said choke line in response to said signal FC(t), and adjusting said flow control device in response to said signal FC(t) to control choke line fluid flow rate to maintain said signal $P_{ann}(t)$ below said formation fracture pressure and above said formation pore pressure.

24. The method of claim 23 further comprising the steps of, measuring actual inlet flow rate of fluid flowing through said fluid injection line using an inlet flow measurement device (52) arranged and designed to generate a signal $F_{in}(t)$ representative of actual fluid injection line fluid flow rate as a function of time (t), and transmitting said actual inlet flow rate signal $F_{in}(t)$ to said central control unit, said central control unit arranged and designed to receive said signal $F_{in}(t)$.

25. The method of claim 24 wherein, said central control unit is further arranged and designed to receive said signal $F_{in}(t)$ and to determine said formation pore pressure as a function of said signals $F_{out}(t)$ and $P_{out}(t)$ when said flow control device controls fluid flow rate through said choke line such that said signal $F_{in}(t)$ first becomes consistently less than said signal $F_{out}(t)$, and said method further comprises the step of, determining said formation pore pressure as a function of said signals $F_{out}(t)$ and $P_{out}(t)$.

26. The method of claim 25 wherein, said central control unit is further arranged and designed to calculate an increase in fluid weight to be circulated through said fluid flow path based upon said formation pore pressure.

27. The method of claim 24 wherein, said central control unit is further arranged and designed to receive said signal $F_{in}(t)$ and to determine said formation fracture pressure as a function of said signals $F_{out}(t)$ and $P_{out}(t)$ when said flow control device controls fluid flow rate through said choke line such that said signal $F_{in}(t)$ first becomes consistently greater than said $F_{out}(t)$, and said method further comprises the step of, determining said formation fracture pressure as a function of said signals $F_{out}(t)$ and $P_{out}(t)$.

28. The method of claim 23 further comprising the steps of, measuring actual inlet pressure in said fluid injection line using an inlet pressure measurement device (62) arranged and designed to generate a signal $P_{in}(t)$ representative of actual fluid injection line pressure as a function of time (t), and transmitting said actual inlet pressure signal $P_{in}(t)$ to said central control unit, said central control unit arranged and designed to receive said signal $P_{in}(t)$.

29. The method of claim 23 further comprising the steps of, establishing a communication link (97) between said central control unit and a remote unit (91, 93, 95, 99) and transmitting rig data from said central control unit to said remote unit via said communication link for observation of said rig data by well control experts.

30. The method of claim 23 further comprising the steps of, simulating a well control event and training rig personnel to respond to said well control event by performing one or more steps of said method.

31. The method of claim 23 wherein, said signal FC(t) is representative of choke line pressure required as a function of time (t) to maintain said signal $P_{ann}(t)$ below said formation fracture pressure and above said formation pore pressure, said flow control device is arranged and designed to control choke line pressure in response to said signal FC(t), and said signal FC(t) controls choke line pressure to maintain said signal $P_{ann}(t)$ below said formation fracture pressure and above said formation pore pressure.

32. In a well control system comprising, a blow-out preventer (32) arranged and designed to close a well bore annulus (18) of a well 12 from atmosphere only at a time when drilling is ceased, a choke line (56) coupled between said well bore annulus and a surface fluid reservoir (42), an outlet flow rate measurement device (50) disposed in said choke line, said outlet flow rate measurement device arranged and designed to measure flow rate through said choke line and to generate a signal $F_{out}(t)$ representative of actual choke line flow rate as a function of time (t), an outlet pressure measurement device (64) disposed in said choke line, said outlet pressure measurement device arranged and designed to measure choke line pressure and to generate a signal $P_{out}(t)$ representative of actual choke line pressure as a function of time (t), a fluid pump (40) in fluid communication with said surface fluid reservoir (42), an inlet flow rate measurement device (52) disposed in an inlet line (48, 50) coupled between said fluid pump (40) and said well bore annulus, said inlet flow rate measurement device arranged and designed to measure fluid flow rate through said inlet line and to generate a signal $F_{in}(t)$ representative of actual inlet line flow rate as a function of time (t), and a flow control device (70) disposed in said choke line and arranged and designed to control fluid flow rate through said choke line, a well control method comprising the steps of, closing said blow-out preventer in response to a fluid influx event, determining formation pore pressure as a function of said signals $F_{out}(t)$ and $P_{out}(f)$ when said flow control device controls fluid flow rate through said choke line such that said signal $F_{in}(t)$ first becomes consistently less than said signal $F_{out}(t)$, calculating an increase in fluid weight of fluid to be circulated through said inlet line, said well bore annulus and said choke line based upon said formation pore pressure, permitting pressure in said well to stabilize while ceasing fluid circulation via said fluid pump and controlling said flow control device to permit no fluid flow therethrough, operating said fluid pump to circulate fluid through said inlet line, said well bore annulus and said choke line, ascertaining a hydrostatic condition of said well by monitoring at least said signal $F_{out}(t)$ while controlling said flow control device to permit incremental increases in fluid flow rate therethrough, permitting said well to achieve steady state after each incremental increase, and confirming said fluid influx event when said signal $F_{out}(t)$ remains greater than said signal $F_{in}(t)$ after steady state is achieved following an incremental increase in fluid flow rate.

33. The well control method of claim 32 further comprising the step of, operating said fluid pump to circulate fluid having said calculated increase in fluid weight through said inlet line, said well bore annulus, and said choke line.

34. The well control method of claim 32 further comprising the steps of, establishing a communication link (97) between at least one of said measurement devices and a remote unit (91, 93, 95, 99), transmitting at least one of said signals $F_{out}(t)$, $P_{out}(t)$, and $F_{in}(t)$ to said remote unit via said communication link for observation of at least one of said signals $F_{out}(t)$, $P_{out}(t)$, and $F_{in}(t)$ by well control experts, and transmitting a control signal from said remote unit to said flow control device via said communication link to control fluid flow rate through said choke line.

35. The well control method of claim 32 wherein, said fluid influx event is a simulated fluid influx event and said steps of said well control method are conducted to train rig personnel in proper well control procedures.

* * * * *